US006334556B1

(12) United States Patent
Bougamont et al.

(10) Patent No.: US 6,334,556 B1
(45) Date of Patent: Jan. 1, 2002

(54) CAP FOR SEALING A LIQUID PRODUCT CONTAINER

(75) Inventors: Jean-Louis Bougamont, Eu; Emmanuel Canu, Etalondes; Christophe Roy, Dieppe, all of (FR)

(73) Assignee: Rexam Sofab, Le Treport (FR)

( * ) Notice: Subject to any disclaimer, the term of this patent is extended or adjusted under 35 U.S.C. 154(b) by 0 days.

(21) Appl. No.: 09/787,411

(22) PCT Filed: Sep. 20, 1999

(86) PCT No.: PCT/FR99/02224

§ 371 Date: Mar. 22, 2001

§ 102(e) Date: Mar. 22, 2001

(87) PCT Pub. No.: WO00/17062

PCT Pub. Date: Mar. 30, 2000

(30) Foreign Application Priority Data

Sep. 23, 1998 (FR) ..... 98 11844

(51) Int. Cl.[7] ..... B65D 41/32

(52) U.S. Cl. ..... 222/553; 222/548

(58) Field of Search ..... 222/546, 548, 222/549, 553, 554

(56) References Cited

U.S. PATENT DOCUMENTS

| | | | | | |
|---|---|---|---|---|---|
| 3,149,755 | A | * | 9/1964 | Porter et al. | 222/548 |
| 3,204,836 | A | * | 9/1965 | Joffe | 222/554 |
| 5,071,017 | A | * | 12/1991 | Stull | 222/548 |
| 5,325,999 | A | * | 7/1994 | Gueret | 222/553 |
| 5,358,146 | A | * | 10/1994 | Stull | 222/548 |
| 5,785,213 | A | * | 7/1998 | Guillot | 222/553 |

* cited by examiner

*Primary Examiner*—Philippe Derakshani
*Assistant Examiner*—Thach H. Bui
(74) *Attorney, Agent, or Firm*—Bacon & Thomas, PLLC

(57) ABSTRACT

The invention relates to a capsule for closing a receptacle (R) for a liquid and for dispensing said liquid, said capsule being characterized in that it comprises: A capsule for closing a receptacle (R) for a liquid and for dispensing said liquid, said capsule being characterized in that it comprises: an inner support element (1) designed to be fixed on the neck (C) of the receptacle (R) and including a central bushing (11) having a side wall provided with an ejection orifice (10); and an outer closure element (2) that is fastened onto said inner element (1) and which includes a central ring (21) provided with an outlet duct (20), said central ring (21) being designed to surround said bushing (11) in coaxial and rotary manner so as to establish at least one closed position in which the ejection orifice (10) is sealed and at least one dispensing position in which said orifice is in communication with the outlet duct (20).

13 Claims, 1 Drawing Sheet

CAP FOR SEALING A LIQUID PRODUCT CONTAINER

Figure 1:
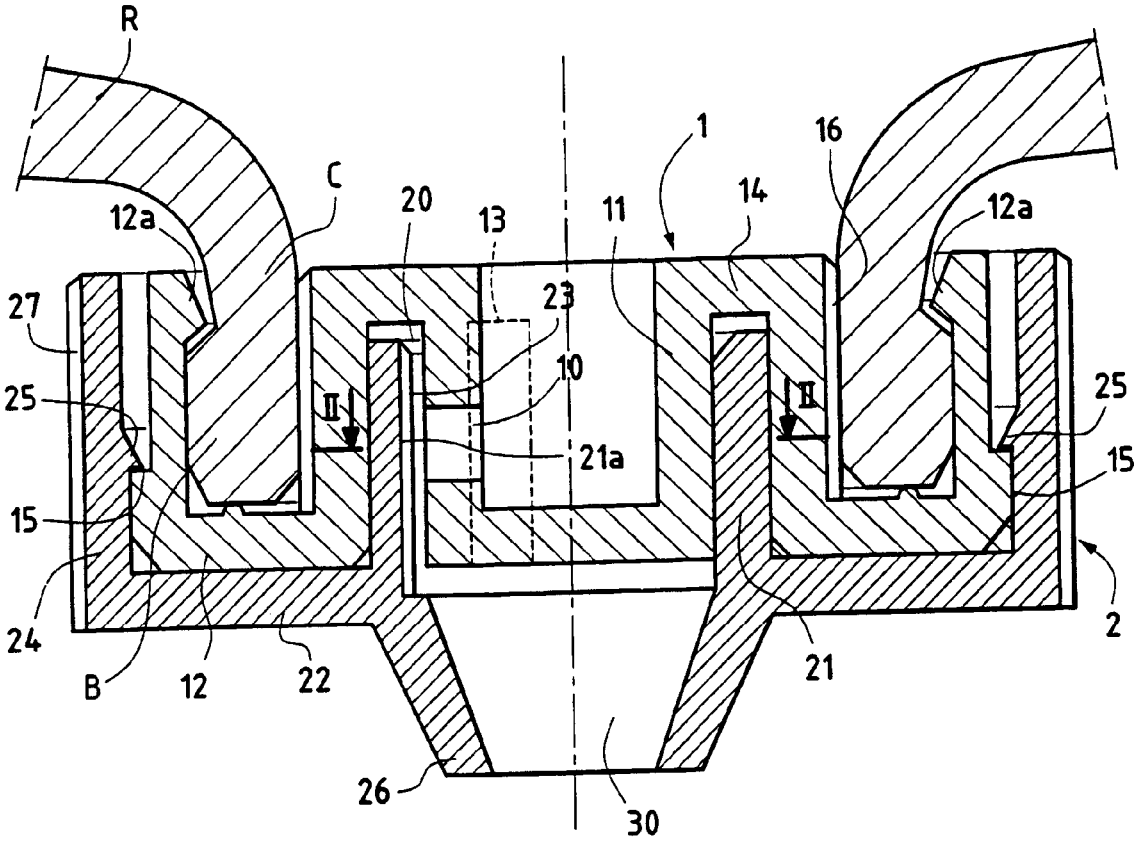

The present invention relates to a capsule for closing a receptacle for a liquid and for dispensing said liquid. More precisely, the invention relates to closing flexible and elastically deformable receptacles.

Closing receptacles for liquids and, in particular, for cosmetics (milks, gels, creams . . . ) is conventionally ensured by means of a removable cap screwed or snap-fastened on the neck of a receptacle that can be flexible or rigid. However, that method of closure requires the cap to be put back on systematically after each occasion on which liquid is removed.

Unfortunately, in some circumstances, the user does not carry out that operation and/or loses the cap, thus leaving the receptacle permanently open, and thereby leading to a serious risk of the quality of the liquid deteriorating.

Furthermore, it is sometimes difficult to close the receptacle when too much liquid is deposited around the neck of the receptacle and can interfere with the cap being screwed-on or snap-fastened. It is thus necessary to clean the neck before closing the receptacle.

In addition, conventional closure methods require the neck of the receptacle to be provided with capretaining members such as threads or fastening lugs, thereby complicating the manufacturing process.

In a variant, the cap is constituted by a fixed portion provided with an outlet duct, and a moving portion connected to the fixed portion by means of a hinge and forming means for closing said duct.

However, that variant is very bulky since the two portions are disposed outside the receptacle and, in the open position, the moving portion projects from the neck.

Furthermore, dispensing of the liquid can be hindered by the moving portion which remains fixed to the fixed portion.

In embodiments having threads, the cap is sometimes constituted by a portion that is moved axially by being screwed onto a fixed portion.

The cap is thus closed by co-operation between the ejection orifice of the outlet duct and a pin.

However, during axial displacement of the moving portion to the closed position, an additional and unwanted quantity of liquid is ejected.

A variant also exists to the embodiment described in EP 0 452 196, the variant comprising:

an inner support element designed to be fixed on the neck of the receptacle and including a central bushing having a side wall provided with an ejection orifice; and an outer closure element that is fastened onto said inner element so that it cannot be displaced axially and which includes a central ring provided with an outlet duct, said central ring being designed to surround said bushing in coaxial and rotary manner so as to establish at least one closed position in which the ejection orifice is sealed and at least one dispensing position in which said orifice is in communication with the outlet duct.

However, that variant does not make it possible to ensure that the outer closure element is locked in a position in which the outlet duct is closed and sealed.

An object of the present invention is to resolve the technical problems posed by previous closure methods.

This object of the invention is achieved by means of a capsule of the above-mentioned type, said capsule being characterized in that the inside wall of said ring is provided, over an angular sector, with a recess having both side edges that respectively form two abutments designed to co-operate with a bulge carried by the outside wall of said bushing and also a ridge suitable for co-operating resiliently with said bulge to produce a snap action corresponding to the outer element passing into the closed position in which the outlet duct defined by said recess is sealed.

According to an advantageous characteristic, on either side of the dispensing position, the inside wall of said ring is in sealed sliding contact with the outside wall of the bushing.

In these conditions, the angular distance on the bushing between the bulge and the ejection orifice is not greater than the angular length of the sector forming the outlet duct of the ring.

According to yet another characteristic, said ring is extended axially by an annular lip defining a substantially tapering conial tip.

According to other characteristics, the inner element includes a peripheral collar of U-shaped section that is fitted over and that locks onto the neck of the receptacle.

In a particularly advantageous variant, the central bushing is fully received inside the neck of the receptacle by being fastened by a spacer to the inner branch of said collar.

In another variant, the inside wall of said collar is provided with splines ensuring locking of the inner element against rotation.

In addition, the central ring is fastened laterally, via a shoulder, to a peripheral skirt provided with a fastening member for fastening onto the inner element.

In an advantageous variant, said ejection orifice is formed by a loophole made in the side wall of the central bushing.

The capsule of the invention is ergonomic by offering compactness, and it adapts very easily to standard receptacle necks.

In the closed position it ensures perfect sealing and in the open position it ensures even and accurate dispensing.

The sealed closed position is achieved by rotating the outer element on the inner element and is accompanied by a snap action which ensures that the closure is locked and sealed.

In addition, operations of assembling together the inner and outer elements and of mounting the assembly on the neck of the receptacle are quick and very easy and they can easily be automated.

Figure 2:
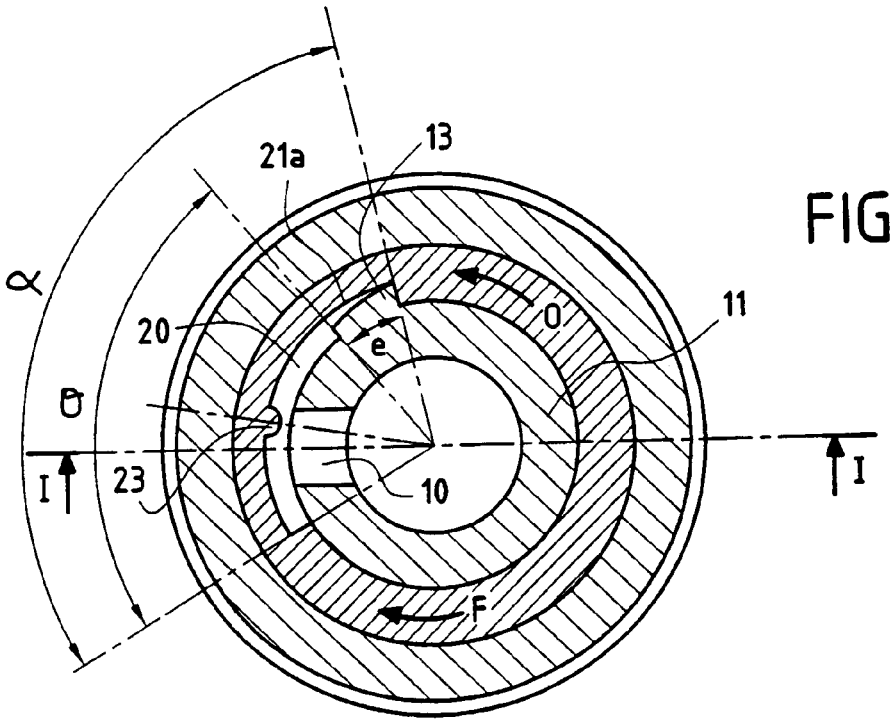

The invention will be better understood on reading the following description accompanied by the drawing, in which:

FIG. 1 is an axial section view of an embodiment of the capsule of the invention; and FIG. 2 is a view partially in section on II—II of the embodiment of FIG. 1, in the open position.

The capsule shown in FIGS. 1 and 2 is designed to ensure the closure of a receptacle R for liquid and, more particularly, for cosmetics of the milk, gel, or cream type, and, in the open position, it also enables the liquid to be dispensed.

The capsule comprises a support element 1 designed to be fixed on the neck C of the receptacle R and including a central bushing 11 having a side wall provided with an ejection orifice 10 for ejecting the liquid. The capsule also comprises a closure element 2 which is designed to be mounted by fastening onto the outside of the support element. However, the element 2 cannot be displaced axially relative to the support 1. To this end, the outer closure element 2 includes a central ring 21 surrounding the bushing 11 in coaxial and rotary manner in a single transverse plane. The ring 21 includes an outlet duct 20 that is capable of being put into communication with the ejection orifice 10 in at least one "dispensing" position. On either side of this position, the inside wall of the ring is in sealed sliding contact with the outside wall of the bushing and closes the orifice 10 is sealed manner.

The inner element 1 also includes a peripheral collar 12 of U-shaped section that is fitted over and that locks onto the rim of the neck C of the receptacle R.

To this end, the collar 12 is fitted with fastening members 12*a* designed to co-operate with the lip B of the neck C.

The central bushing 11 is fully received inside the neck C by being fastened by a spacer 14 to the inner branch of the collar 12, thereby preserving the appearance of the receptacle and offering compactness.

In the embodiment shown, the outside wall of the ring 21 is in contact with the wall of the inner branch of the collar 12.

In addition, the inside edge of the ring 21 is chamfered to enable it to be inserted in the annular housing situated between the bushing 11 and the collar 12.

To prevent the bushing 11 from rotating relative to the neck C, the inside wall of the collar 12 is provided with splines 16 which clamp radially against the inside wall of said neck thereby ensuring rotary locking of the inner element 1. Consequently, only the outer element 2 with its ring 21 can move.

The ring 21 can be turned through 360° or, as in the embodiment shown, through at least a portion θ of the circumference.

In FIG. 2, the outer element 2 is shown in the open position after having been turned in the direction of arrow O. From this position, it is possible to close the ejection orifice 10 of the bushing 11 by turning the ring 21 in the direction of arrow F.

In this case, an angular sector α is defined by the side edges forming abutments with a recess 21*a* defining the duct 20. The abutments are designed to co-operate with a bulge 13 carried by the outside wall of said bushing 11 so as to establish respectively a sealed closed position of the capsule, and a fully open position of the ejection orifice 10 for dispensing the liquid.

The width of the bulge 13 defines the size of the portion θ over which the ring 21 can turn freely within the sector α.

The angular distance on the bushing 11 between the bulge 13 and the ejection orifice 10 is thus not greater than the angular length of the sector a forming the duct 20.

The recess 21*a* is provided with a ridge 23 extending parallel to the generator lines of the bushing 21. The ridge 23 is suitable for co-operating by resilient deformation with the bulge 13 to produce a snap action corresponding to the ejection orifice 10 passing into the sealed closed position.

The central ring 21 is fastened laterally, via a shoulder 22, to a peripheral skirt 24.

The skirt 24 is provided with a fastening member 25 co-operating with a radial projection 15 carried by the outer branch of the collar 12 of the inner element 1 in order to secure the outer element 2 thereon.

The skirt 24 is preferably provided with fluting 27 to improve manual grip while turning the outer element 2.

The outlet duct 20 opens out longitudinally to the outside (i.e. downwards in FIGS. 1 and 2) and is suitable for being fed transversely with liquid via the ejection orifice 10 which is formed in the side wall of the bushing 11 in the form of a loophole. The ring 21 is extended axially, beyond the shoulder 22, by an annular lip 26. The lip 26 defines a tapering conial tip 30 enabling the liquid to be made to flow one way in funneled manner, and thus enabling accurate dispensing to be achieved.

What is claimed is:

1. A capsule for closing a receptacle for a liquid and for dispensing said liquid, said capsule comprising:

an inner support element designed to be fixed on the neck of the receptacle and including a central bushing having a side wall provided with an ejection orifice; and an outer closure element that is fastened onto said inner element so that it cannot be displaced axially and which includes a central ring provided with an outlet duct, said central ring being designed to surround said bushing in coaxial and rotary manner so as to establish at least one closed position in which the ejection orifice is sealed and at least one dispensing position in which said orifice is in communication with the outlet duct, wherein the inside wall of said ring is provided, over an angular sector, with a recess having both side edges that respectively form two abutments designed to co-operate with a bulge carried by the outside wall of said bushing and also a ridge suitable for cooperating resiliently with said bulge to produce a snap action corresponding to the outer element passing into the closed position in which the outlet duct defined by said recess is sealed.

2. A capsule according to claim 1, wherein on either, side of the dispensing position, the inside wall of said ring is in sealed sliding contact with the outside wall of the bushing.

3. A capsule according to claim 1 or 2, wherein the angular distance on the bushing between the bulge and the ejection orifice is not greater than the angular length of the sector forming the outlet duct of the ring.

4. A capsule according to claims 1 or 2, wherein said ring is extended axially by an annular lip defining a substantially tapering conial tip.

5. A capsule according to claim 1, wherein the inner element includes a peripheral collar of U-shaped section that is fitted over and that locks onto the neck of the receptacle.

6. A capsule according to claim 5, wherein the central bushing is fully received inside the neck of the receptacle by being fastened by a spacer to the inner branch of said collar.

7. A capsule according to claim 5, wherein the inside wall of said collar is provided with anti-rotation locking splines.

8. A capsule according to claim 1 or 2, wherein the central ring is fastened laterally, via a shoulder, to a peripheral skirt provided with a fastening member for fastening onto the inner element.

9. A capsule according to claim 1 or 2, wherein said ejection orifice is formed by a loophole made in the side wall of the central bushing.

10. A Capsule according to claim 1 or 2, wherein the angular distance on the bushing between the bulge and the ejection orifice is not greater than the angular length of the sector forming the outlet duct of the ring and wherein said ring is extended axially by an annular lip defining a substantially tapering conial tip.

11. A capsule according to claim 5, wherein the inner element includes a peripheral collar of U-shaped section that is fitted over and that locks onto the neck of the receptacle and wherein the central bushing is fully received inside the neck of the receptacle by being fastened by a spacer to the inner branch of said collar.

12. A capsule according to claim 5, 6 or 7, wherein the central ring is fastened laterally, via a shoulder, to a peripheral skirt provided with a fastening member for fastening onto the inner element.

13. A capsule according to claim 5, 6 or 7, wherein said ejection orifice is formed by a loophole made in the side wall of the central bushing.

* * * * *